US005690595A

United States Patent [19]

Quinones

[11] Patent Number: 5,690,595

[45] Date of Patent: Nov. 25, 1997

[54] BELT WITH PROTRUDING ELASTIC BANDS CONNECTED TO HAND WEIGHTS

[76] Inventor: Juan A. Quinones, 511 NW. 108th Ter., Pembroke Pines, Fla. 33026

[21] Appl. No.: 762,326

[22] Filed: Dec. 9, 1996

[51] Int. Cl.[6] ..... A63B 21/02

[52] U.S. Cl. ..... 482/124; 482/105; 482/74

[58] Field of Search ..... 482/105, 106, 482/108, 124, 125, 126, 121, 74

[56] References Cited

U.S. PATENT DOCUMENTS

| | | | |
|---|---|---|---|
| 4,441,707 | 4/1984 | Bosch . | |
| 4,623,143 | 11/1986 | Wuellenweber | 482/105 |
| 4,627,618 | 12/1986 | Schwartz | 482/105 |
| 4,647,037 | 3/1987 | Donohue . | |
| 4,684,122 | 8/1987 | Desmone et al. . | |
| 4,722,523 | 2/1988 | Yang | 482/126 |
| 4,733,861 | 3/1988 | Plunkett, III . | |
| 5,141,223 | 8/1992 | Block . | |
| 5,362,295 | 11/1994 | Nurge . | |
| 5,484,366 | 1/1996 | Wilkinson | 482/124 |
| 5,518,480 | 5/1996 | Frappier . | |

*Primary Examiner*—Lynne A. Reichard

*Attorney, Agent, or Firm*—Oltman, Flynn & Kubler

[57] ABSTRACT

An exercise device to be used while walking for exercising the back, abdominal, chest, shoulders, arms, hands, buttocks and leg muscles while walking. A first preferred embodiment of the device includes a elastic neoprene rubber belt having a first and second pair of metal O-rings sewn onto the left and right sides respectively of the belt and approximately 16 long latex hoses attached to each pair. The opposite loose ends of hoses have third and fourth pairs of metal O-rings sewn thereon attached to cylindrical neoprene rubber covers that house a pair of coaxial weights therein. The second embodiment of the device has a T-cross-sectional shaped weight formed by a cylindrical plastic body and an enlarged end cap for fitting within a user's hands and through-holes for tieing. A third embodiment uses alternating hollow cylindrical weights of 1 and 2 lbs each, where each weight has identical outside dimensions. The lengths of the elastic hoses can be varied depending upon the arm swinging of the user.

17 Claims, 4 Drawing Sheets

BELT WITH PROTRUDING ELASTIC BANDS CONNECTED TO HAND WEIGHTS

This invention relates to an exercise device, and in particular to a belt having protruding elastic bands that are connected to hand weights which allows the user to exercise their back, abdominal, chest, shoulders, arms, hands, buttocks and leg muscles while walking.

BACKGROUND AND PRIOR ART

Various types of exercise devices including belts and jump ropes have been proposed. See for example U.S. Pat. No. 4,441,707 to Bosch; U.S. Pat. No. 4,647,037 to Donohue; U.S. Pat. No. 4,684,122 to Desmond et al.; U.S. Pat. No. 4,733,861 to Plunkett, III; U.S. Pat. No. 5,141,223 to Block; U.S. Pat. No. 5,362,295 to Nurge; and U.S. Pat. No. 5,518,480 to Frappier. However, none of the cited prior art devices adequately and efficiently allow the user to exercise their back, abdominal, chest, shoulders, arms, hands, buttocks and leg muscles while walking.

Thus, the need exists for improvements over the prior art.

SUMMARY OF THE INVENTION

The first objective of the present invention is to provide an exercise device which allows the user to effectively exercise back, abdominal, chest, shoulders, arms, buttocks, and leg muscles while walking.

The second object of this invention is to provide a portable waist attachment exercise device for allowing users to carry weights in their hands while walking.

The third object of this invention is to provide a portable waist attachment exercise device that gives adequate back support to the wearer while walking with hand weights.

The fourth object of this invention is to provide a portable waist attachment exercise device that allows persons regardless of age or weight to effectively exercise their whole body simply by walking and using attached weights.

Three preferred embodiments are disclosed of a walking exercise apparatus for effectively exercising back, abdominal, chest, shoulders, arms, buttocks and leg muscles. The first embodiment includes a belt for attaching about a user's waist, a first elastic cord attaches a left side of the belt to a first weight sized for a user's left hand, a second elastic cord attaches a fight side of the belt to a second weight sized for a user's right hand, wherein a user alternates swinging the first weight and second weight forward and backward while walking. The belt can be a neoprene rubber belt having a nylon surface with hook and loop fasteners for attaching ends of the belt about the user's waist. The belt can have a width of approximately 4 inches and a thickness of approximately ¼ inches. A first pair of O-rings attaches the left side of the belt to the first elastic cord, and a second pair of O-rings attaches the right side of the belt to the second elastic cord. A third pair of O-rings attaches the first elastic cord to the first weight, and a fourth pair of O-rings attaches the second elastic cord to the second weight. First and second removable neoprene rubber housings are used about the first and second weights. Each housing can have flap covers with hook and loop fasteners thereon. Cylindrical weights with tubular weights therein form coaxial weights that fit inside the housings. Each cord includes a latex hose having an inner diameter of approximately 3/16 inches, an outer diameter of approximately ⅜ inches and a length of approximately 16 inches.

The second preferred embodiment includes a cylindrical housing having an enlarged end cap at one end and through holes on a second end for having outer ends of the elastic cord to inserted therein.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figures 1A, 1B, 1C:
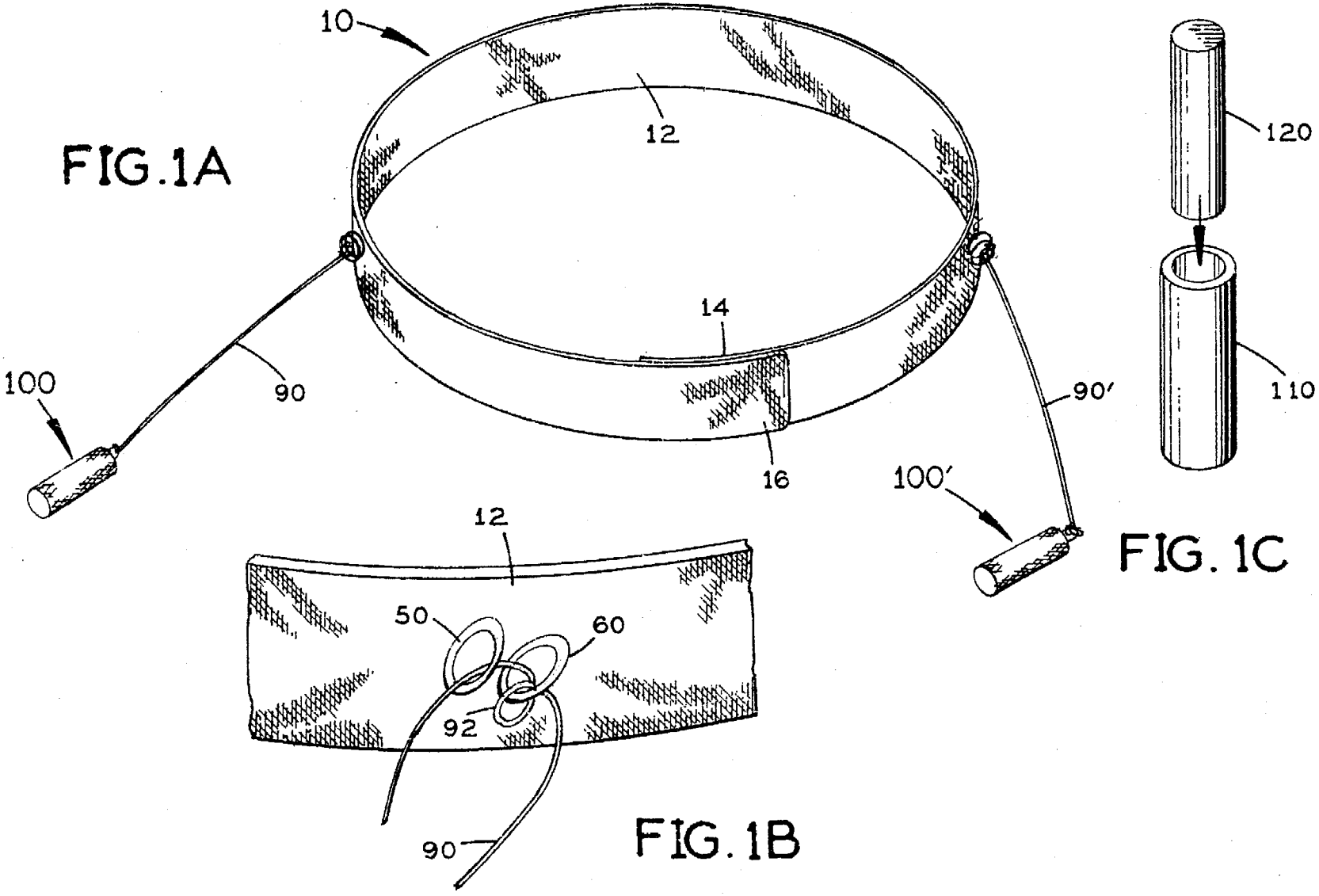
FIG. 1A is a perspective view of a preferred embodiment of the exercise belt with attached weights.
FIG. 1B is an enlarged view of the O rings used for attaching to the weights of FIG. 1A.
FIG. 1C is an enlarged view of the concentric weights used in the embodiment of FIG. 1A.

FIG. 1A is a perspective view of a preferred embodiment 10 of the exercise belt 12 with attached weights 100. Belt 12 can be approximately 4 inches wide by ¼ inches thickness formed from a neoprene foam rubber having a stretch nylon surface. Flap ends 14 and 16 can include fasteners such as hook and loop fasteners(i.e. Velcro®), snaps, buckles and the like, for securing the belt 12 about the weight of a user shown in greater detail in reference to FIGS. 2A–2B.

Figure 1D:
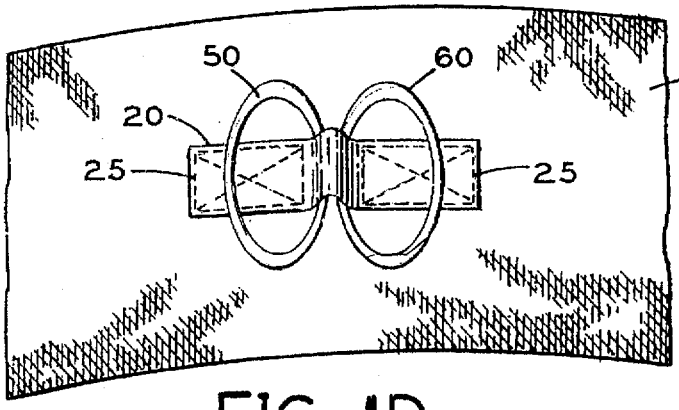
FIG. 1D is an enlarged view of the belt and attached O-rings of FIG. 1A.
Figure 1E:
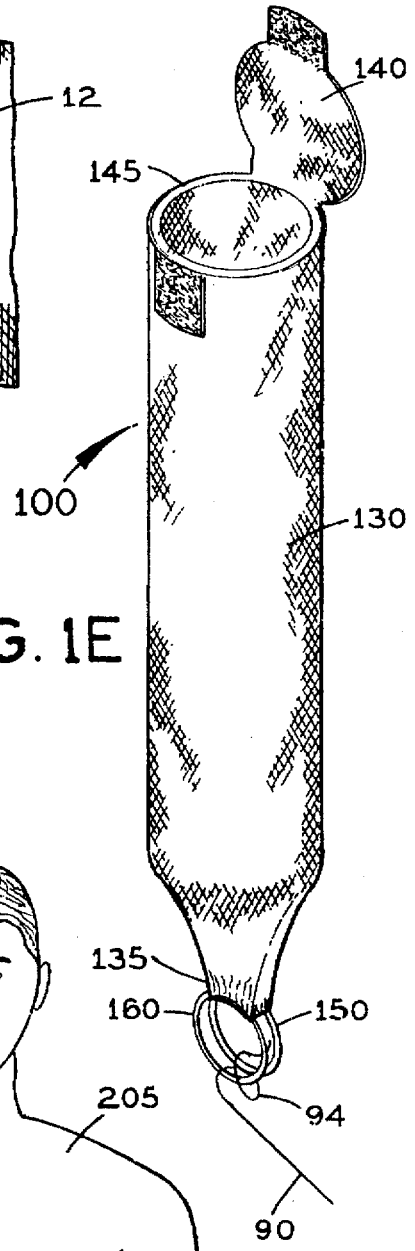
FIG. 1E is an enlarged view of the flexible cover used for the weights of FIG. 1A.

FIG. 1B is an enlarged view of the O rings 50, 60 each having diameters of approximately 1½ inches are used for attaching to the weights 100 and 100' of FIG. 1A. FIG. 1C is an enlarged view of the concentric weights 110, 120 used in the embodiment 10 of FIG. 1A. FIG. 1D is an enlarged view of the belt 12 and attached O-rings 50, 60 of FIG. 1A. FIG. 1E is an enlarged view of the flexible cover 130 used for the weights 100 of FIG. 1A.

Referring to FIGS. 1A–1E, 2 metal O-rings 50, 60 can be secured to opposite exterior sides of belt 12 by a neoprene flap 20 which can be sewn 25 onto the belt 12. Elastic bands 90 and 90' are formed from a latex rubber hose that can have an inner diameter of approximately 3/16 inches and an outer diameter of approximately 3/8 inches, and a length of approximately 16 inches long. Bands 90 and 90' and weights 100, 100' have identical components so that only the components of band 90 and weight 100 will be described. Band 90 has one end 92 tied to the belt 12 by O-rings 50, 60. The opposite end of bands 90 can be tied to O-rings 150, 160. Each of the metal O-rings 50, 60, 150, 160 can be approximately 5/8 inches in diameter. O-rings 150, 160 can be sewn into a bottom portion 135 of neoprene rubber cover flap 130. Weights 110 and 120 can be lead weights of approximately 1 lb apiece, where cylindrical weight 120 can fit inside and be coaxial to tubular weight 110. The weights 110, 120 individually or together can fit inside cover 130 and held in place by a flap 140 that attaches to a top portion of cover 130 by mating fasteners 145 such as hook and loop fasteners (Velcro(®) and the like.

Figure 2A:
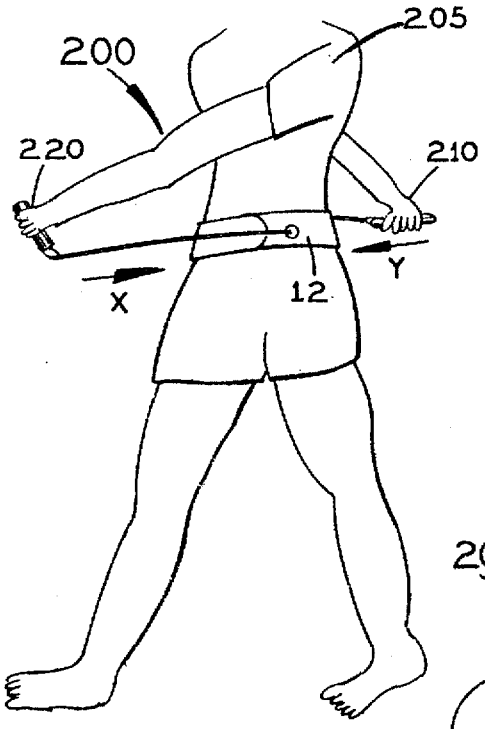
FIG. 2A is a side view of a preferred use of the embodiment of FIG. 1A with a user.
Figure 2B:
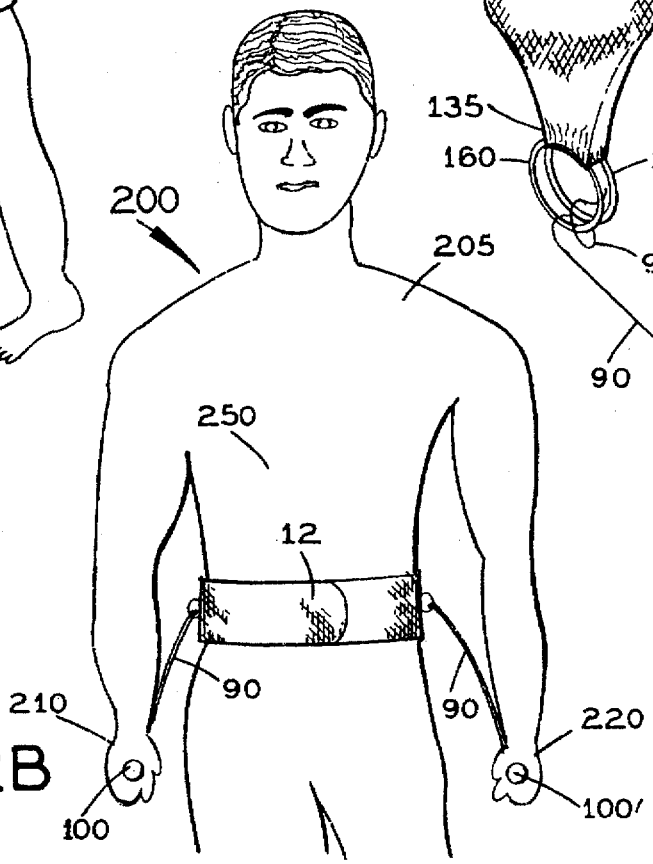
FIG. 2B is a front view of the embodiment user of FIG. 2A.

FIG. 2A is a side view of a preferred use of the embodiment 200 of FIG. 1A with a user 205. FIG. 2B is a front view of the embodiment user 200 of FIG. 2A. Referring to FIGS. 2A–2B, belt 12 is worn around waist 250 of user 205. The length of bands 90, 90' can be adjusted by holding the weights 100, 100' along the user's side as depicted in FIG. 2B, and tieing the weights at those locations to their respective O-rings 50, 60, 150, 160, respectively as depicted in FIGS. 1A–1E. Thus, the user can reduce the amount of slack in bands 90, 90' accordingly. FIG. 2A depicts the user 205 moving the weights in an alternating swinging arm motion along arrows X and Y. A user 205 having a large arm swing can adjust the bands 90, 90' to allow a greater slack length. Users can swing the weights 100, 100' alternating one arm forward and one arm backward while walking at a pace of approximately 2.5 to 4 miles per hour.

Figure 3A:
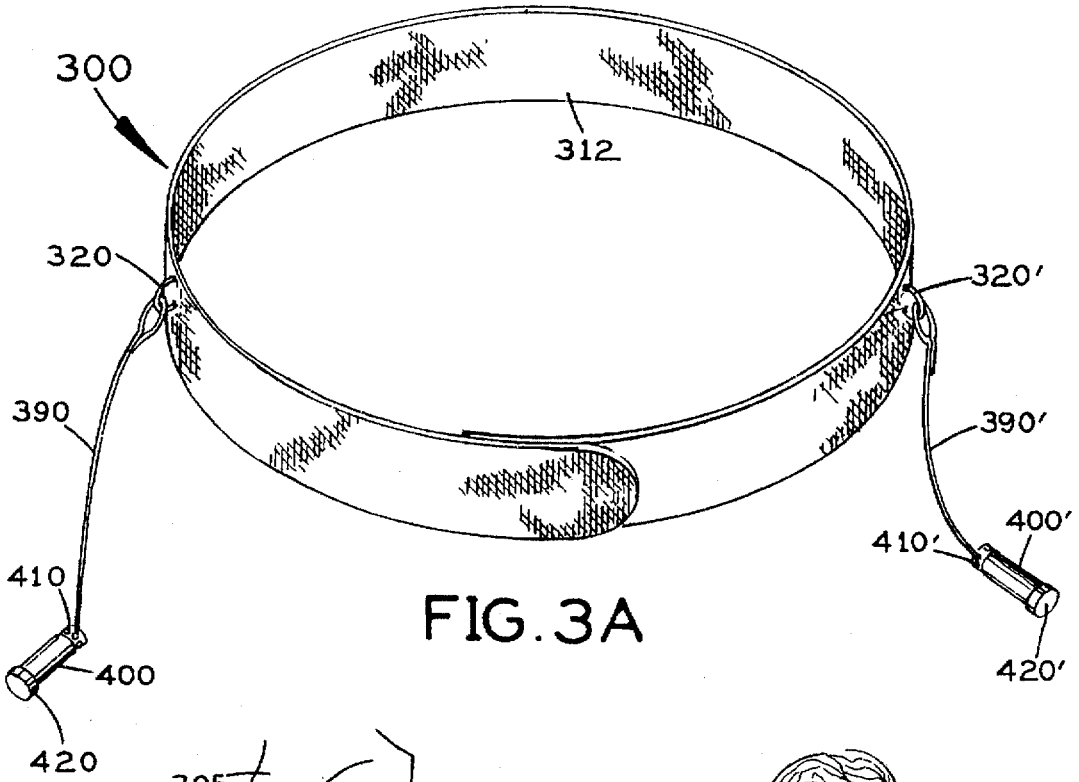
FIG. 3A is a perspective view of a second preferred embodiment of the exercise belt with attached weights.
Figure 3B:
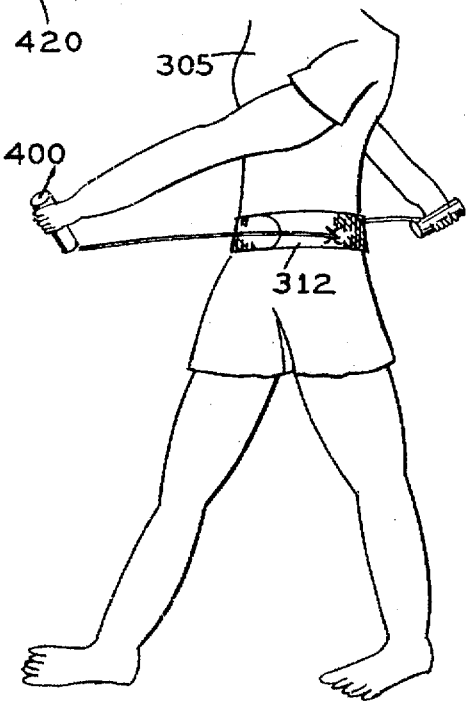
FIG. 3B is a side view of a preferred use of the embodiment of FIG. 3A with a user.
Figure 3C:
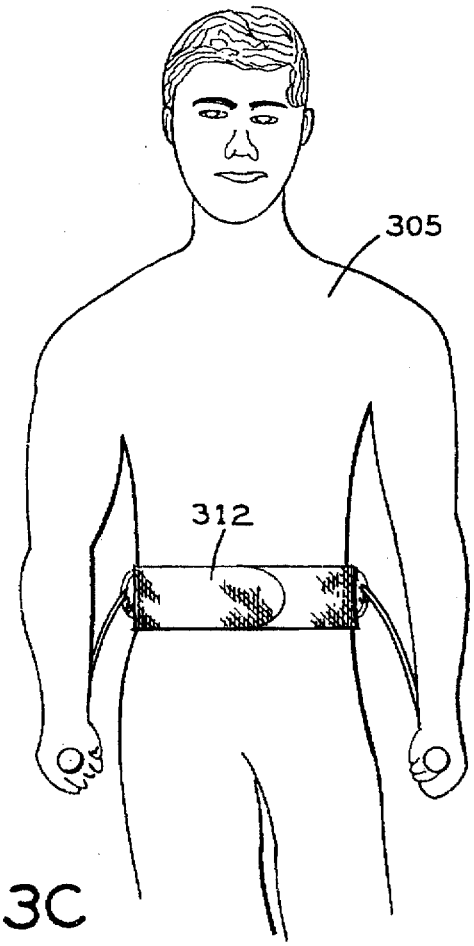
FIG. 3C is a front view of the embodiment user of FIG. 3A.

FIG. 3A is a perspective view of a second preferred embodiment 300 of the exercise belt 312 with attached weights 400, 400'. FIG. 3B is a side view of a preferred use of the embodiment 300 of FIG. 3A with a user 305. FIG. 3C is a front view of the embodiment user 305 of FIG. 3A. Referring to FIGS. 3A–3C, belt 312 and bands 390, 390' correspond to like components 12 and 90, 90' described in the previous figures. Weights 400, 400' can be cylindrically shaped formed of soft plastic having approximately 1¼ inch outside diameter, approximately 1⅛ inch inner diameter and a length of approximately 6½ to approximately 7 inches long. One end of cylinder 400 can include an enlarged diameter screw-on cap 420, 420' and the other end can contain up to approximately 4 through-holes each having a diameter of approximately 3/8 of an inch. Lead weights such as those described in reference to FIG. 1C can be inserted inside cylinders 400, 400'. The cylinders 400, 400' are sized to fit within a user's hands. One end of each band 390, 390' can be attached to belt 312 by looped and tied through a sewn on nylon rubber flap 320, 320', the other end of band 390, 390' can be inserted in and out of the through-holes 410, 410' in a manner similar to shoelaces. User 305 can adjust the length of bands 390, 390' by pulling band ends through the holes 410, 410'. The rest of embodiment 300 of FIGS. 3A–3C operates similar to the embodiment described in reference to FIGS. 1A–1E, 2B, and 2C.

Referring to FIGS. 1A–1E, 2B, 2C, 3A–3C, the handweights 100, 100' function to exercise upper body muscles of the user 205. Hand weights 100, 100' further stretch the elastic bands 90, 90' sending the whole upper body of the user 205 in the opposite direction much smoother and faster, thereby reducing the strain on the shoulders and back and also thereby making the movement of the lower body(legs) easier and faster. The handweights 100, 100' add weight to the upper body, especially during the upper body swing while walking. Thereby functioning to balance the weight of the upper body with the heavier lower body and thereby causing both the upper body and lower body to synchronize with each other.

Referring to FIGS. 1A–1E, 2B, 2C, 3A–3C, the elastic bands 90, 90' connect the weights 100, 100' to the belt 12, which enables the user's upper body to move in a synchronized motion. The elastic bands 90, 90' also function to limit the arm swing forward and back therefore allowing all of the upper body to swing the hand weights 100, 100'. The elastic function of the belt 12 is to minimize any jerking that may be caused by the swinging of the weights 100, 100' along with giving the user some back support during a walking exercise.

Figures 4, 5A, 5B:
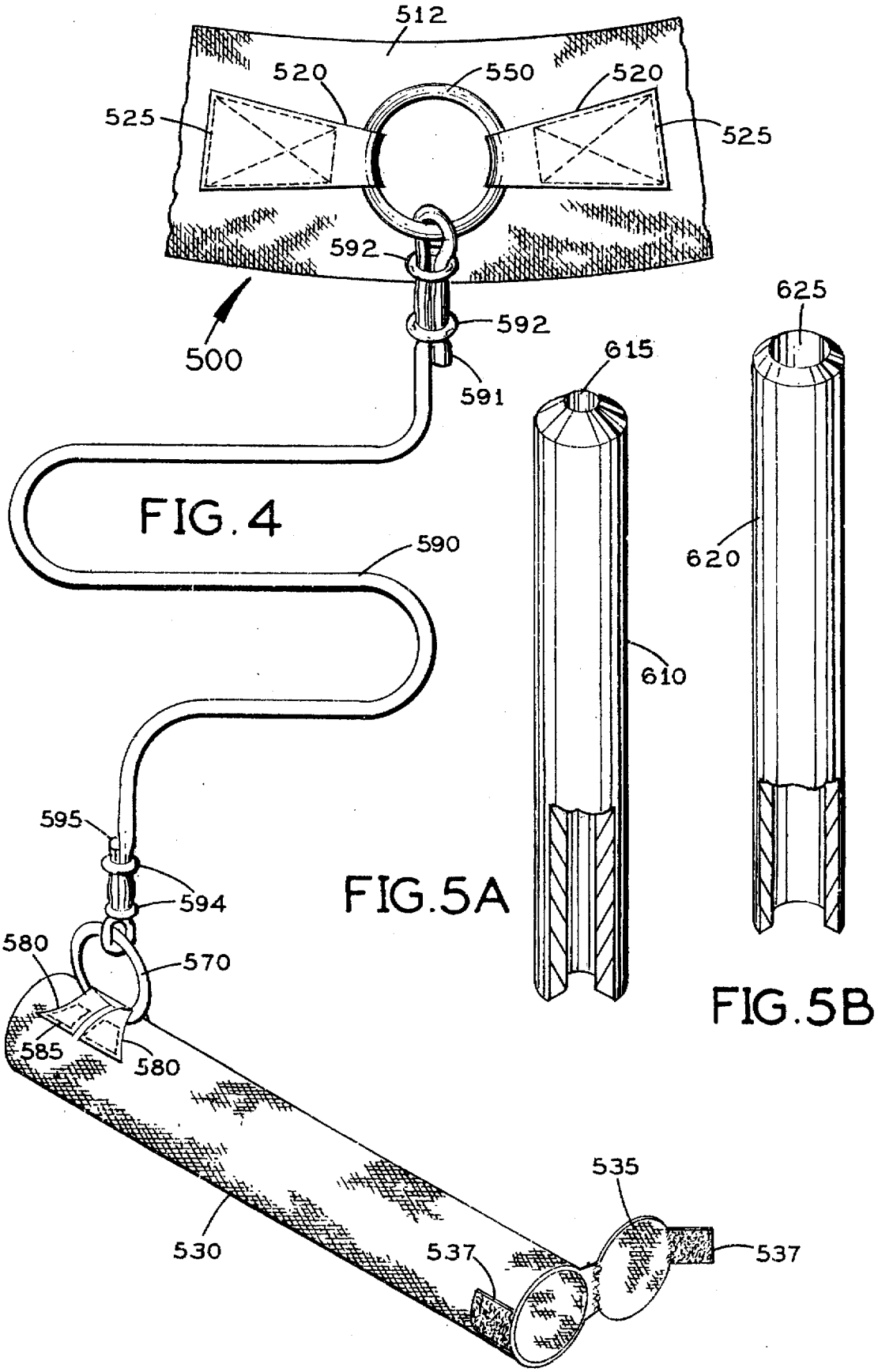
FIG. 4 is an enlarged sectional view of a third preferred embodiment of a belt, cord and attached weight holder cover.
FIG. 5A is an enlarged view of 2 lb weight that can fit within the weight holder cover of FIG. 4.
FIG. 5B is an enlarged view of a 1 lb weight that can fit within the weight holder cover of FIG. 4.

FIG. 4 is an enlarged sectional view of a third preferred embodiment 500. FIG. 5A is an enlarged view of 2 lb weight 610 with a narrow tubular hollow opening 615 therethrough, that can fit within the weight holder cover 530 of FIG. 4. FIG. 5B is an enlarged view of a 1 lb weight 620 having a larger hollow diameter 625 than the preceding FIG. 5A weight, that can fit within the weight holder cover 530 of FIG. 4. Referring to FIGS. 5A–5B, each of the weights 610, 620 can have similar outside cylindrical dimensions of approximately 6–7 inches long with an outside diameter of approximately 1 inch. Referring to FIGS. 4 and 5A–5B, embodiment 500 includes a neoprene rubber belt 512 having neoprene rubber flaps 520 that are sewn at their ends 525 to the belt 512 with a 1½ inch metal O-ring connected between the flaps 520. One bent end 591 of a latex elastic cord 590 is connected to O-ring 550 by a pair of compressed ½ inch metal O-rings 592. A second end 595 of cord 590 is bent around 1 inch metal O-ring 570 and held in place by another pair of compressed ½ inch metal O-rings 594. O-ring 570 is further attached to a neoprene rubber weight cover 530 by a pair of neoprene rubber flaps 580 sewn at their ends 585 to cover 530. A flap cover 535 having fasteners 537 such as hook/loop fasteners, snapable fasteners, and the like can be used to hold either of the weights 610(FIG. 5A) and 620 (FIG. 5B) there within. Although the embodiment 500 describes using metal O-rings, other types of O-rings such as but not limited to neoprene rubber O-rings can be used.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A walking exercise apparatus for effectively exercising back, abdominal, chest, shoulders, arms, buttocks and leg muscles, the apparatus comprising:

a belt for attaching about the waist of a user;

a first elastic cord having a first end attached to a side of the belt, and a second end;

a second elastic cord having a first end attached to another side of the belt, and a second end; and a first weight sized for a user's left hand attached to the second end of the first elastic cord;

a second weight sized for a user's right hand attached to the second end of the second elastic cord, wherein user alternates swinging the first weight and second weight forward and backward while walking; and first and second weight covers receiving said first and second weights and attached respectively to said second ends of said first and second elastic cords, said weight covers having hollow interiors for inserting said weights.

2. The walking exercise apparatus of claim 1, wherein the belt includes:

a neoprene rubber belt having a nylon surface; and hook and loop fasteners for attaching ends of the belt about the user's waist.

3. The walking exercise apparatus of claim 1, wherein the belt includes:

a width of approximately 4 inches;

a thickness of approximately ¼ inches.

4. The walking exercise apparatus of claim 1, wherein the belt includes:

a first pair of O-rings for being attached to the left side of the belt for connecting the belt to the first elastic cord; and a second pair of O-rings for being attached to the right side of the belt for connecting the belt to the second elastic cord.

5. The walking exercise apparatus of claim 4, further comprising:

a third pair of O-rings for attaching the first elastic cord to the first weight; and a fourth pair of O-rings for attaching the second elastic cord to the second weight.

6. The walking exercise apparatus of claim 1, further comprising:

a first removable neoprene rubber housing for the first weight; and a second removable neoprene rubber housing for the second weight.

7. The walking exercise apparatus of claim 6, further comprising:

a first flap cover having fasteners for fastening to mateable fasteners on the first neoprene rubber housing; and a second flap cover having fasteners for fastening to mateable fasteners on the second neoprene rubber housing.

8. The walking exercise apparatus of claim 7, further comprising:

a first cylindrical weight and a first tubular weight for fitting within the first cylindrical weight forming first coaxial weights that fit inside the first neoprene rubber housing; and a second cylindrical weight and a second tubular weight for fitting within the first cylindrical weight forming second coaxial weights that fit inside the second neoprene rubber housing.

9. The walking exercise apparatus of claim 1, wherein the first elastic cord and the second elastic cord each includes:

a latex hose having an inner diameter of approximately 3/16 inches, an outer diameter of approximately ⅜ inches and a length of approximately 16 inches.

10. The walking exercise apparatus of claim 1, wherein the first weight and the second weight each includes:

a cylindrical housing having an enlarged end cap at one end and through holes on a second end for having outer ends of the elastic cord to inserted therein.

11. The walking exercise apparatus of claim 10, wherein the first weight and the second weight each includes:

a first cylindrical weight and a first tubular weight for fitting within the first cylindrical weight forming first coaxial weights that fit inside the cylindrical housing.

12. The walking exercise apparatus of claim 10, wherein the first weight and the second weight each includes:

outside diameters of approximately 6–7 inches long and a diameter of approximately 1 inch.

13. The walking exercise apparatus of claim 10, wherein the first weight and the second weight each includes:

a first cylindrical weight of approximately 1 pound; and a second cylindrical weight of approximately 2 pounds, wherein the first and the second cylindrical weights having substantially similar outside dimensions.

14. A walking exercise apparatus for effectively exercising back, abdominal, chest, shoulders, arms, buttocks and leg muscles, the apparatus comprising:

an elastic belt for attaching about waist of a user;

a first elastic cord having a first end attached to a side of the belt, and a second end;

a second elastic cord having a first end attached to another side of the belt, and a second end; and a first cylindrical flexible weight cover sized for a user's left hand attached to the second end of the first elastic cord;

a first weight insertable and removable from the first flexible weight cover;

a second cylindrical flexible weight cover sized for a user's right hand attached to the second end of the second elastic cord;

a second weight insertable and removable from the second flexible weight cover, wherein a user alternates swinging the first weight and second weight within their respective cover, forward and backward while walking.

15. The walking exercise apparatus of claim 14, wherein the first and the second flexible weight covers each include:

an attachable and detachable flap cover.

16. The walking exercise apparatus of claim 14, wherein the first and the second weights each include:

a substantially cylindrical hollow weight of approximately 1 lb.

17. The walking exercise apparatus of claim 14, wherein the first and the second weights each include:

a substantially cylindrical hollow weight of approximately 2 lbs.

* * * * *